US009175911B2

(12) United States Patent
Huang

(10) Patent No.: US 9,175,911 B2
(45) Date of Patent: Nov. 3, 2015

(54) HEAT SINK ASSEMBLY

(76) Inventor: Tsung-Hsien Huang, I-Lan Hsien (TW)

( * ) Notice: Subject to any disclaimer, the term of this patent is extended or adjusted under 35 U.S.C. 154(b) by 906 days.

(21) Appl. No.: 13/176,748

(22) Filed: Jul. 6, 2011

(65) Prior Publication Data

US 2012/0222836 A1 Sep. 6, 2012

(30) Foreign Application Priority Data

Mar. 4, 2011 (CN) ..... 2011 1 0052090

(51) Int. Cl.
*H01L 23/427* (2006.01)
*F28D 15/02* (2006.01)
*F28F 9/00* (2006.01)

(52) U.S. Cl.
CPC ..... *F28D 15/02* (2013.01); *F28F 9/002* (2013.01)

(58) Field of Classification Search
CPC ..... F28D 15/0275; H01L 23/4006
USPC ..... 165/104.33, 80.1–80.5
See application file for complete search history.

(56) References Cited

U.S. PATENT DOCUMENTS

| | | | | |
|---|---|---|---|---|
| 4,080,703 | A * | 3/1978 | Beck, Jr. | 29/890.038 |
| 6,504,712 | B2 * | 1/2003 | Hashimoto et al. | 361/679.54 |
| 6,853,555 | B2 * | 2/2005 | Fichera et al. | 361/700 |
| 6,966,363 | B2 * | 11/2005 | Gailus et al. | 165/185 |
| 7,426,112 | B2 * | 9/2008 | Chi-Wei et al. | 361/700 |
| 7,511,958 | B2 * | 3/2009 | Lin | 361/700 |
| 7,650,929 | B2 * | 1/2010 | Huang | 165/80.3 |
| 7,714,423 | B2 * | 5/2010 | Reid et al. | 257/686 |
| 8,191,612 | B2 * | 6/2012 | Huang | 165/80.3 |
| 8,225,847 | B2 * | 7/2012 | Li et al. | 165/80.3 |
| 2005/0180110 | A1 * | 8/2005 | I-Yung et al. | 361/700 |
| 2007/0121291 | A1 * | 5/2007 | Wang et al. | 361/695 |
| 2010/0032137 | A1 * | 2/2010 | Huang et al. | 165/104.26 |
| 2010/0181048 | A1 * | 7/2010 | Hwang et al. | 165/104.26 |
| 2010/0236756 | A1 * | 9/2010 | Yang | 165/80.3 |
| 2011/0240258 | A1 * | 10/2011 | Yang et al. | 165/67 |
| 2012/0106088 | A1 * | 5/2012 | Huang et al. | 361/720 |
| 2013/0000870 | A1 * | 1/2013 | Wu | 165/104.26 |
| 2013/0020055 | A1 * | 1/2013 | Wu | 165/104.26 |
| 2013/0032313 | A1 * | 2/2013 | Wu et al. | 165/104.26 |
| 2013/0056179 | A1 * | 3/2013 | Wu et al. | 165/104.26 |
| 2013/0126125 | A1 * | 5/2013 | Wang et al. | 165/67 |

* cited by examiner

*Primary Examiner* — Allen Flanigan
*Assistant Examiner* — For K Ling
(74) *Attorney, Agent, or Firm* — Pai Patent & Trademark Law Firm; Chao-Chang David Pai

(57) ABSTRACT

A heat sink assembly includes a heat pipe, a plurality of metal support members, and a mounting spring plate. The heat pipe has a first heat-receiving surface. Each metal support member has a second heat-receiving surface. The mounting spring plate has a heat pipe mounting portion for press-fitting therein the heat pipe without using solder, a plurality of support portions affixed to respective metal support members, and a plurality of mounting portions for securing to a base of a heat source. After the heat pipe is secured to the mounting spring plate, the first heat-receiving surface of the heat pipe would be protruded from the mounting spring plate. The second heat-receiving surfaces of the metal support members are flush with the first heat-receiving surface of the heat pipe. By adopting the solder-less press-fitting, the manufacturing cost and process can be lowered and simplified respectively.

8 Claims, 8 Drawing Sheets

HEAT SINK ASSEMBLY

BACKGROUND OF THE INVENTION (a) Field of the Invention

The instant disclosure relates to heat sink technology; more particularly, to a heat sink assembly having a heat pipe in direct contact with the heat source for enhancing heat transfer efficiency.

(b) Description of the Prior Art

Referring to FIGS. 1-3, a conventional heat sink comprises a heat pipe a, a locating member b, two fixation spring plates d, and a heat-transfer plate e. The locating member b has a recess c formed thereon. The heat pipe a is soldered to the recess c of the locating member b with a solder paste. The two fixation spring plates d are fastened to two opposite sides of the locating member b. The heat-transfer plate e is soldered underneath the heat pipe a and the locating member b with a solder paste. Screws f are inserted through the spring plates d and screwed into a heat source carrier frame to affix the heat sink thereon. The heat-transfer plate e is kept in contact with the heat source. Heat is transferred from the heat source through the heat-transfer plate e to the heat pipe a for heat dissipation. The aforesaid heat sink has the following drawbacks: 1. Heat is transferred from the heat source to the heat pipe through the heat-transfer plate, which implies the heat transfer efficiency is lower due to indirect heat transfer, and the presence of the heat-transfer plate greatly increases the weight of the heat sink; 2. Bonding between the heat pipe and the locating member is done by soldering using solder paste, which would affect heat transfer efficiency and complicate the manufacturing procedure.

SUMMARY OF THE INVENTION

The instant disclosure has been accomplished under the circumstances in view. It is one object of the instant disclosure to provide a heat sink assembly, which has the characteristics of light weight, low manufacturing cost, ease of manufacturing and high heat transfer rate.

To achieve this and other objects of the instant disclosure, a heat sink assembly includes a heat pipe, a plurality of metal support members, and a mounting spring plate. The heat pipe has a first heat-receiving surface. Each metal support member has a second heat-receiving surface. The mounting spring plate has: a heat pipe mounting portion for securing the heat pipe by a solder-less press-fit technique; a plurality of support portions affixed to respective metal support members; and a plurality of mounting portions for securing onto the base of a heat source. After the heat pipe is affixed to the mounting spring plate, the first heat-receiving surface would extend beyond the mounting spring plate. The second heat-receiving surfaces of the metal support members are disposed coplanarly with the first heat-receiving surface of the heat pipe.

For the heat sink assembly of the instant disclosure, heat is transferred directly from the heat source to the heat pipe in raising the heat transfer performance. Also, the omission of the heat-transfer plate decreases the weight of the heat sink assembly. Furthermore, the adoption of the solder-less press-fit technique reduces the manufacturing cost and simplifies the manufacturing process.

DETAILED DESCRIPTION OF THE PREFERRED EMBODIMENTS

The various objects and advantages of the instant disclosure will be more readily understood from the following detailed descriptions when read in conjunction with the appended drawings. However, the appended drawings are for references and explanation purposes only, therefore are not used to restrict the scope of the instant disclosure.

Figure 1:
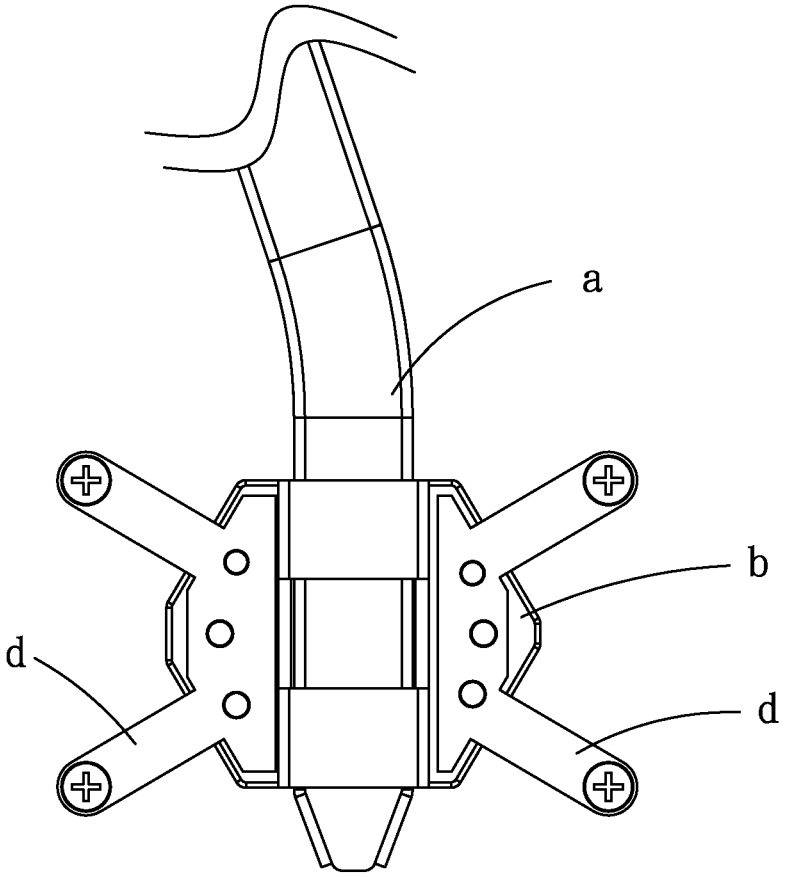
FIG. 1 PRIOR ART
FIG. 1 is a bottom view of a heat sink according to the prior art.
Figure 2:
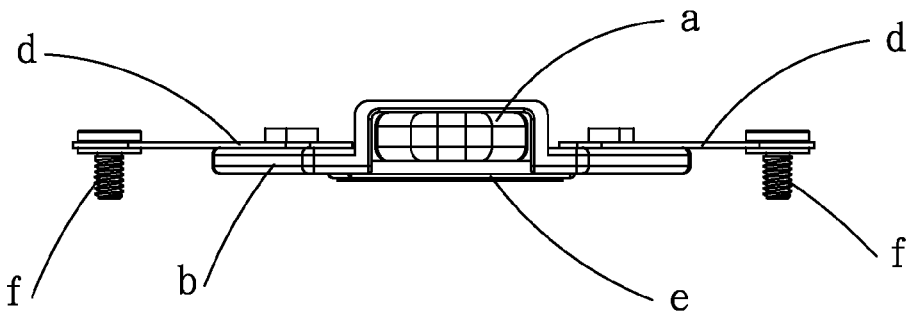
FIG. 2 PRIOR ART
FIG. 2 is a side view of the prior art heat sink.
Figure 3:
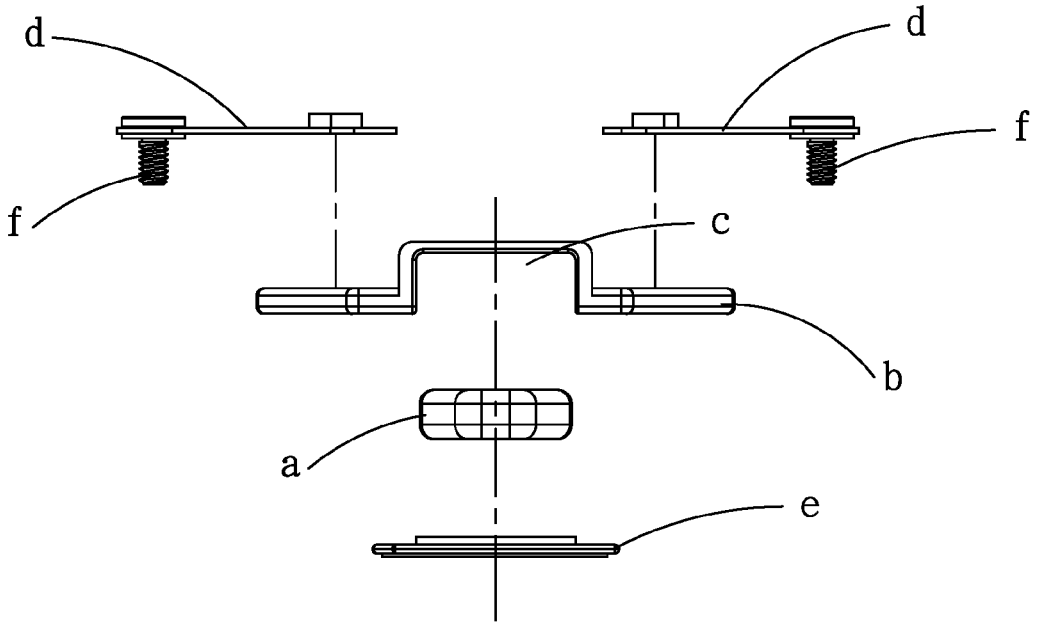
FIG. 3 PRIOR ART
FIG. 3 is an exploded side view of the prior art heat sink.
Figure 4:
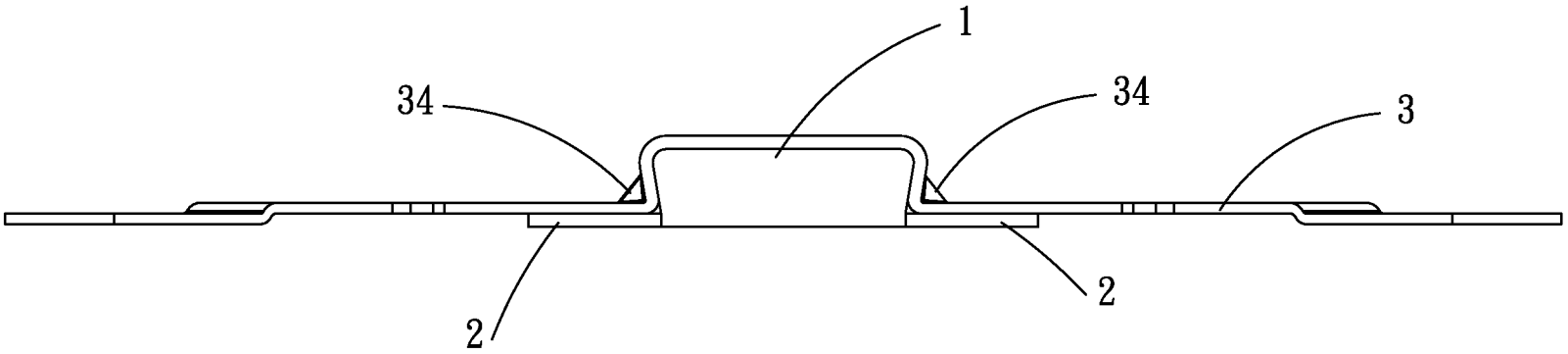
FIG. 4 is a side view of a heat sink assembly in accordance with the instant disclosure.
Figure 5:
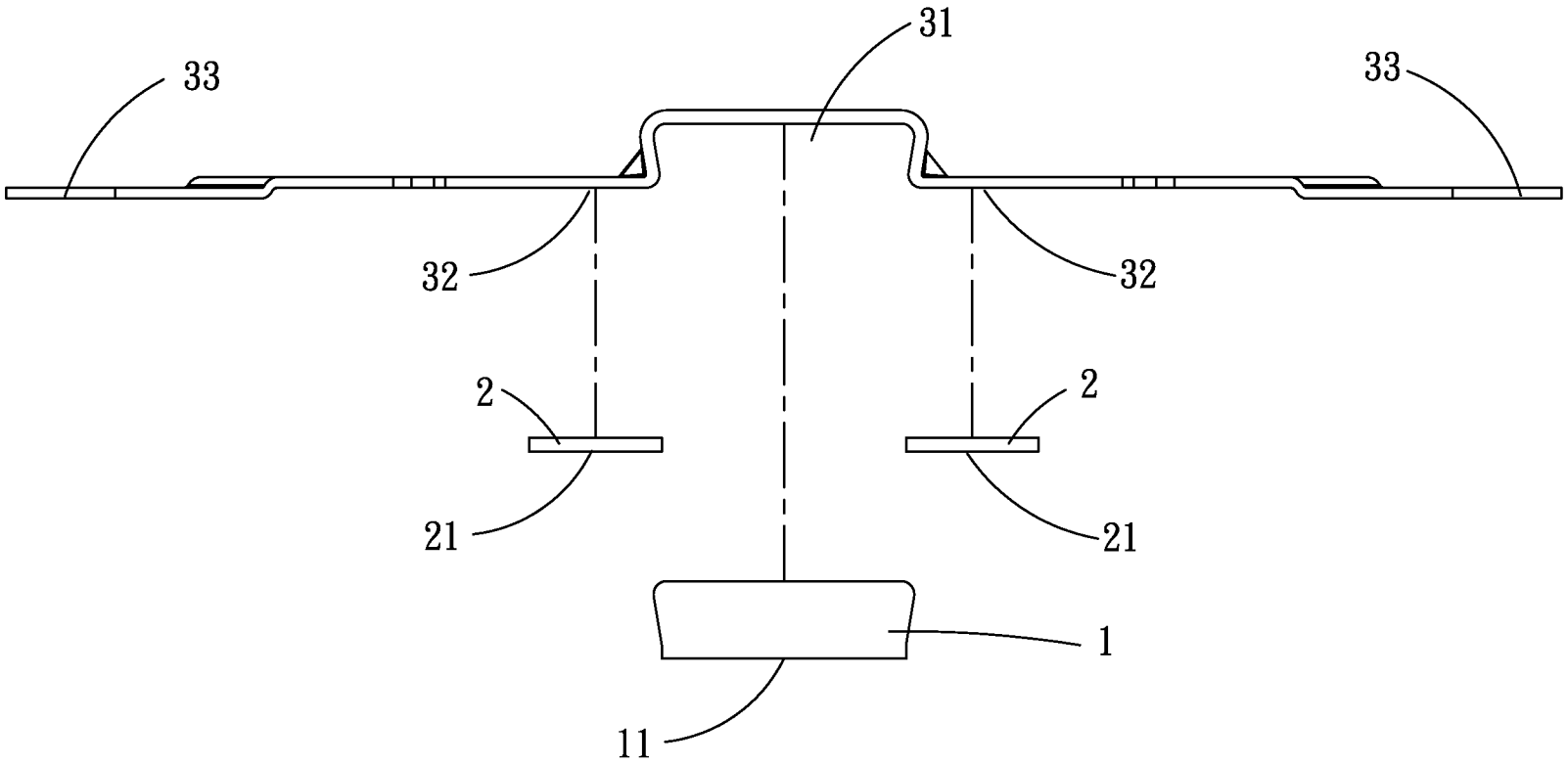
FIG. 5 is an exploded side view of the heat sink assembly in accordance with the instant disclosure.
Figure 6:
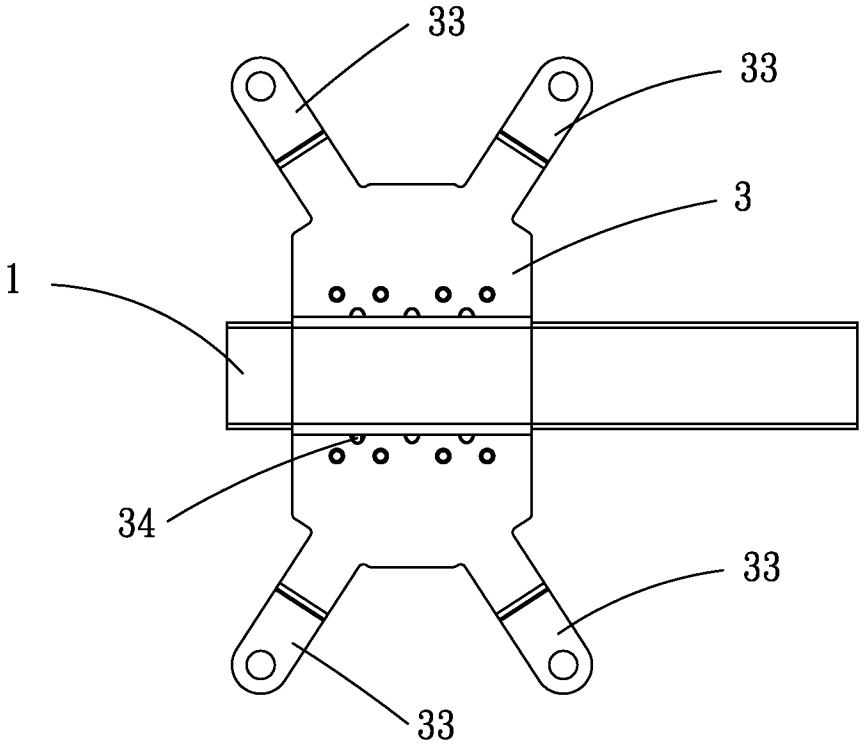
FIG. 6 is a top view of the heat sink assembly in accordance with the instant disclosure.
Figure 7:
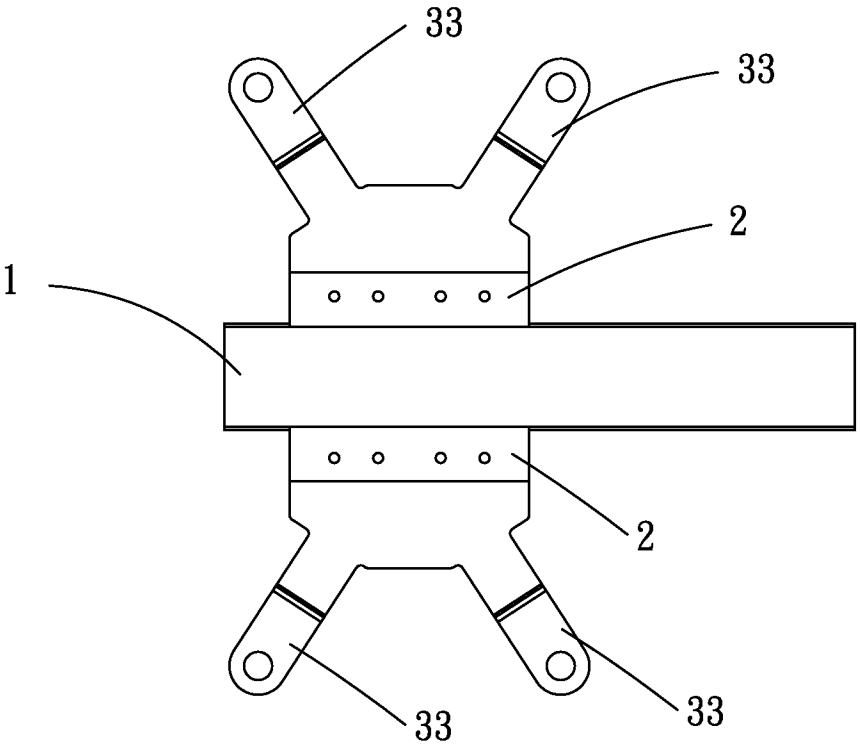
FIG. 7 is a bottom view of the heat sink assembly in accordance with the instant disclosure.
Figure 8:
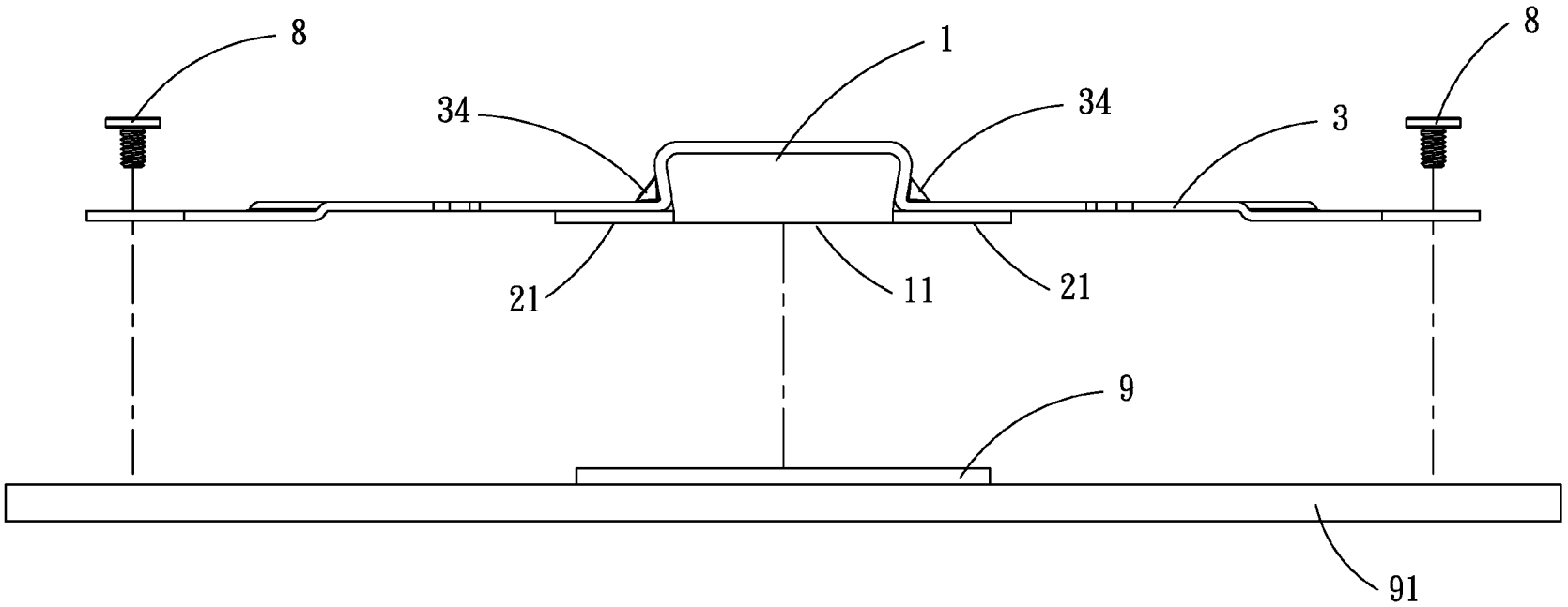
FIG. 8 is an applied view of the heat sink assembly in accordance with the instant disclosure in use.
Figure 9:
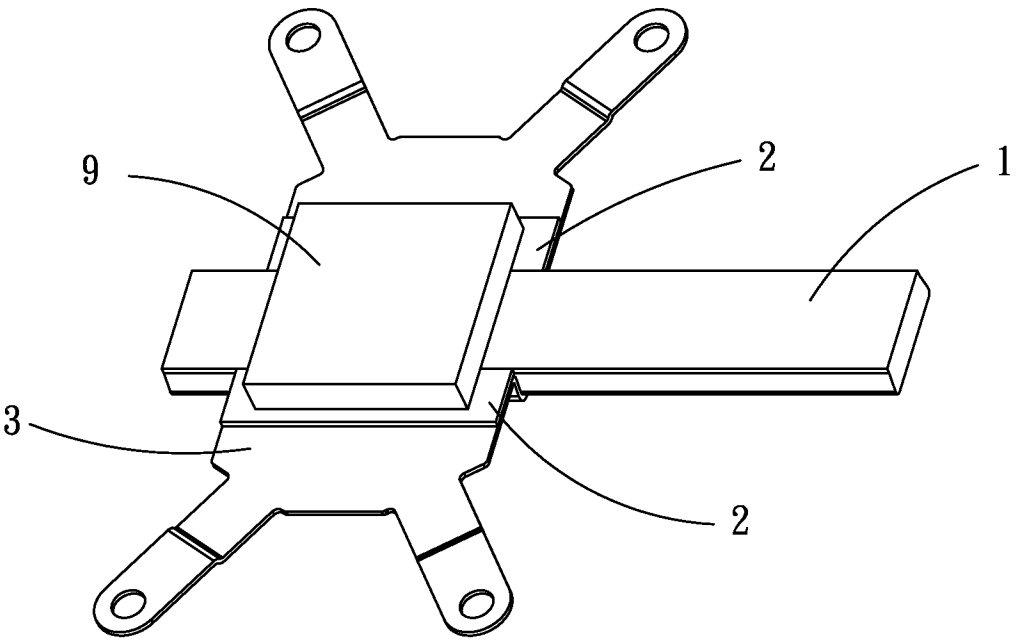
FIG. 9 is another applied view of the heat sink assembly in accordance with the instant disclosure in use.

Please refer to FIGS. 4-9, which show a heat sink assembly comprising a heat pipe 1, two metal support members 2, and a mounting spring plate 3.

The heat pipe 1 has a first heat-receiving surface 11.

Each metal support member 2 has a second heat-receiving surface 21.

The mounting spring plate 3 has; a heat pipe mounting portion 31, which can be, preferably, an inverted conical recess formed thereon for engagement with the heat pipe 1 by means of solder-less press-fit; two support portions 32 joined with respective metal support members 2; and four mounting portions 33 for fixation to a heat source carrier frame 91 that carries a heat source 9.

The mounting spring plate 3 does not totally enclose the heat pipe 1. After the heat pipe 1 and the mounting spring plate 3 are secured together, the first heat-receiving surface 11 of the heat pipe 1 protrudes downwardly from the mounting spring plate 3. The first heat-receiving surface 11 is kept in flush with the second heat-receiving surfaces 21 of the two metal support members 2.

In use, the first heat-receiving surface 11 of the heat pipe 1 and the second heat-receiving surface 21 of each metal support member 2 are kept in direct contact with the surface of the heat source 9. Screws 8 are installed to affix the four mounting portions 33 of the mounting spring plate 3 to the heat source carrier frame 91 that carries the heat source 9. As the heat pipe 1 is kept in direct contact with the surface of the heat source 9, the heat sink assembly achieves higher heat transfer efficiency. Further, as the mounting spring plate 3 and the heat pipe 1 are fastened together by means of a solder-less press-fit technique, the manufacturing of the heat sink assembly is simplified Further, the mounting spring plate 3 can be made having reinforcing ribs 34 disposed between the heat pipe mounting portion 31 and the support portions 32 to reinforce the structural strength.

Further, the two metal support members 2 are not only to provide support to the heat pipe 1, but also to assist the transfer of heat energy from the heat source 9 to the heat pipe 1. Preferably, the two metal support members 2 are abutted to the heat pipe 1 laterally to hold the heat pipe 1 in position.

Further, in order to optimize the heat transfer efficiency, the combined surface area of the first heat-receiving surface 11 of the heat pipe 1 and the second heat-receiving surface 21 of each metal support member 2 is preferably greater than the surface area of the hot side of the heat source 9.

Further, the metal support members 2 and the mounting spring plate 3 can be formed integrally in one piece. Alternatively, the metal support members 2 and the mounting spring plate 3 can be separately made and then riveted together.

Further, the mounting spring plate 3 is preferably made by stainless steel; the metal support members 2 are preferably selected from the material group of aluminum, copper, and other metal materials with good thermal conductivity. Further, the thickness for the top portion of the mounting spring plate 3 is preferably controlled within 0.5 mm.

In summary, the instant disclosure is able to achieve the pre-determined objectives and resolve issues facing by conventional heat pipe assemblies. The instant disclosure has novelty and non-obviousness in conforming to the requirements for patent application. Therefore, the present patent application is submitted to obtain a patent for protecting the intellectual property right of the inventor.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A heat sink assembly, comprising:

a heat pipe having a first heat-receiving surface and a cross section;

a plurality of metal support members each being a flat plate of uniform thickness having a top side and a second heat-receiving surface at a bottom side parallel to the top side;

a mounting spring plate having a bottom surface, a heat pipe mounting portion which is an inverted conical recess in the bottom surface with a cross section matching the cross section of the heat pipe, a plurality of support portions at the bottom surface, and a plurality of mounting portions for securing onto a base of a heat source, the heat pipe filling up the inverted conical recess of the mounting spring plate and directly secured thereto by solder-less press-fitting, the support portions being affixed to the top side of respective metal support members;

wherein the first heat-receiving surface of the heat pipe protrudes outwardly and perpendicularly away from the bottom surface of the mounting spring plate so that the first heat-receiving surface of the heat pipe is parallel to and spaced from the bottom surface of the mounting spring plate, the second heat-receiving surfaces of the support members being flush with the first heat-receiving surface of the heat pipe.

2. The heat sink assembly as claimed in claim 1, wherein the mounting spring plate and the metal support members are formed integrally in one piece.

3. The heat sink assembly as claimed in claim 1, wherein the mounting spring plate and the metal support members are riveted together.

4. The heat sink assembly as claimed in claim 1, wherein the mounting spring plate is made of stainless steel.

5. The heat sink assembly as claimed in claim 1, wherein at least one reinforcing rib is disposed between the heat pipe mounting portion and the support portions.

6. The heat sink assembly as claimed in claim 1, wherein the metal support members are made from a material selected from the group consisting of aluminum, copper, and other thermal conductive metal materials.

7. The heat sink assembly as claimed in claim 1, wherein the metal support members are kept in contact with the heat pipe.

8. The heat sink assembly as claimed in claim 1, wherein a combined surface area of the first heat-receiving surface of the heat pipe and the second heat-receiving surface of each metal support member is greater than a surface area of the heat source to be cooled.

* * * * *